US006009914A

United States Patent [19]

Castaño

[11] Patent Number: 6,009,914

[45] Date of Patent: Jan. 4, 2000

[54] TUBE COMPRESSION LIMITING APPARATUS AND METHOD

[75] Inventor: Francisco Castaño, Houston, Tex.

[73] Assignee: Geometrica, Inc., Houston, Tex.

[21] Appl. No.: 09/157,713

[22] Filed: Sep. 21, 1998

[51] Int. Cl.[7] ..... F16L 9/00; E04H 12/10

[52] U.S. Cl. ..... 138/172; 138/109; 138/177; 403/171; 52/653.2

[58] Field of Search ..... 138/172, 177, 138/178, 109, 174, DIG. 11; 403/171–173, 218; 52/651.03, 651.04, 651.08, 724.1, 638, 653.2

[56] References Cited

U.S. PATENT DOCUMENTS

| | | | |
|---|---|---|---|
| 940,173 | 11/1909 | Mace | 138/172 |
| 2,895,753 | 7/1959 | Fentiman | 446/125 |
| 2,916,109 | 12/1959 | Fentiman | 52/654.1 |
| 2,931,467 | 4/1960 | Fentiman | 403/171 |
| 2,964,147 | 12/1960 | Fentiman | 52/653.2 |
| 2,976,968 | 3/1961 | Fentiman | 52/654.1 |
| 3,079,681 | 3/1963 | Fentiman | 29/525 |
| 3,081,601 | 3/1963 | Fentiman | 405/221 |
| 3,152,819 | 10/1964 | Fentiman | 403/172 |
| 3,275,351 | 9/1966 | Fentiman | 403/171 |
| 3,309,121 | 3/1967 | Fentiman | 403/176 |
| 3,481,095 | 12/1969 | Beziat | 52/638 |
| 4,267,863 | 5/1981 | Burelle | 138/172 X |
| 4,324,083 | 4/1982 | Johnson, Jr. | 52/653.2 |
| 5,051,019 | 9/1991 | Kohl | 403/172 X |
| 5,263,296 | 11/1993 | Spera | 52/638 |

*Primary Examiner*—Patrick Brinson

*Attorney, Agent, or Firm*—Haynes and Boone, L.L.P.; James R. Bell

[57] ABSTRACT

A structural member includes a tube member having first and second opposite ends. An elongated portion between the opposite ends terminates at a flattened, tapered portion adjacent each end, and a crimped portion at each end. At least one reinforcing member is provided adjacent each end. Each reinforcing member is attached to the tube adjacent the flattened, tapered portion, and extends transversely through the tube member.

20 Claims, 2 Drawing Sheets

TUBE COMPRESSION LIMITING APPARATUS AND METHOD

BACKGROUND

The disclosures herein relate generally to space frame joints and more particularly to a method and apparatus for limiting end-crippling tube compression in a tube element adjacent a hub connection.

Separable joints, such as those used in space frame construction are generally a cylindrical hub which includes a plurality of radially directed slots extending axially along the circumferential surface of the hub. The slots have opposed surfaces facing each other which are ribbed. The ribs extend axially along the opposed surfaces.

Tubular frame members are flattened and crimped at their opposed ends. The crimped ends include elongated flat surfaces extending outwardly, or away from each other. The crimped ends are ribbed in a pattern which can be mated into engagement with the ribs in the hub slots. In this manner, each end of the tubular frame member may be slidably inserted into a respective hub slot and several tubular frame members may be connected at one end to a hub slot to form a spider, i.e., a hub having a plurality of tubes extending radially outwardly therefrom, each tube terminating at a free end.

The free end of each tube can be similarly connected to another hub. Thus, a framework of interconnected spiders formed of tubes and hubs can be joined to form a pre-assembled or modular section of a flat roof, a doomed roof, a wall, etc., to be joined with other sections to eventually form a complete structure. The structure, once completed, is then covered with a selected cladding which is attached to the structural framework by means of an interfacing cladding support system. The cladding may be fabric, corrugated steel plates, glass, and other selected materials and may include combinations of these materials for architectural design purposes. For example, a domed roof may be clad with steel and may include a pattern of glass panels in a portion of the roof which has an aesthetic effect when viewed from the interior of the structure.

Joining the pre-assembled sections of the framework is difficult and time-consuming. Each section has a periphery including a plurality of hubs. These hubs are connected to their respective section by tube members as mentioned above. When sections are to be joined, additional members of tubing have one end connected to the peripheral hubs of one section, and have their opposite ends connected to the peripheral hubs of an adjoining section. Because the modular sections are often quite large, e.g., 50 feet square, they must be hoisted into their approximate position, suspended by a crane and then a few of the additional members of tubing must be individually and manually aligned with and inserted into the peripheral hubs to stabilize the hoisted section relative to the section of framework to which the hoisted section is being attached. Once stabilized, additional members of tubing are used to complete the interconnection of the hoisted section into the framework.

There are various known tubular structural devices which have been developed. U.S. Pat. No. 2,895,753 discloses tubular members having crimped ends matingly engaged with keyed slots for retaining the crimped tube ends. U.S. Pat. No. 2,916,109 discloses a similar tube and hub construction used to form reinforced metal wall sections. U.S. Pat. No. 2,931,467 discloses a tube and hub construction for use in fabricating scaffolds, trusses, bridges, walls, roofs and towers. U.S. Pat. No. 2,964,147 discloses a tube and hub construction directed to radial and/or diagonal struts and ties. U.S. Pat. No. 2,976,968 discloses a parallel member tubular wall construction using tubular members with flattened and crimped end sections. U.S. Pat. No. 3,079,681 discloses an improved keyed connection between the hub and the crimped tube end. U.S. Pat. No. 3,081,601 discloses tubular members connected to hubs for forming a demountable dock. U.S. Pat. No. 3,152,819 discloses a key and keyway joint for tube and hub structural assemblies. U.S. Pat. No. 3,275,351 discloses a hub having keyway connectors with integral nut receiving ends and an annular recess of conical cross-section at one end with a complimentary tapered washer. U.S. Pat. No. 3,309,121 discloses a connector for slidingly receiving formed tube ends. The connector is formed by a stack of disks having key slots formed therein.

Because the tube members are structural elements, they have tensile, compression and bending forces acting thereon. One problem caused by the forces of compression acting on the tube members is commonly referred to as end-crippling. This occurs in the tube member near the connection to the hub member, and is concentrated in an area of the tube member adjacent to where the circular tube member is formed into opposed flattened, tapered areas having a crimped end.

One attempt to overcome the end-crippling problem has been to weld a triangular shaped plate directly on each of the opposed flattened, tapered areas. The purpose of the plates is to reinforce the ends of the tube members against the end-crippling loads acting thereon. Another approach to overcome this problem is to add an external collar which attaches to the circular portion of the tube immediately adjacent the flattened, tapered areas. This also reinforces the ends of the tube members against end-crippling compression loading. However, the addition of the plates and collar involves additional parts and is a time consuming manufacturing operation which adds costs to the overall structure. In addition, these reinforcing members protrude from and obstruct the outer surface of the tube members. As a result, such obstructions can interfere with the process of applying a smooth cladding to the assembled support members.

Therefore, what is needed is an apparatus and a method which overcomes the end-crippling problems associated with compression loads on the tube members, and which provides non-protruding adequate reinforcement of the ends of the tube members which adds minimum cost and production time to the structure.

SUMMARY

One embodiment, accordingly, provides reinforcement members at opposite ends of the tube members. To this end, a structural member comprises a tube member having an elongated portion, a flattened tapered portion, and a crimped end. At least one member is attached to the tube adjacent the flattened, tapered portion and extends transversely through the tube.

A principal advantage of this embodiment is that the reinforcing members are individually installed and positioned to provide adequate reinforcement of the ends of the tube member by using a minimal amount of material. Installation is quick and efficient and cost is nominal. In addition, the outer peripheral surface of the tube member is unobstructed by the reinforcing members.

DETAILED DESCRIPTION

Figure 1:
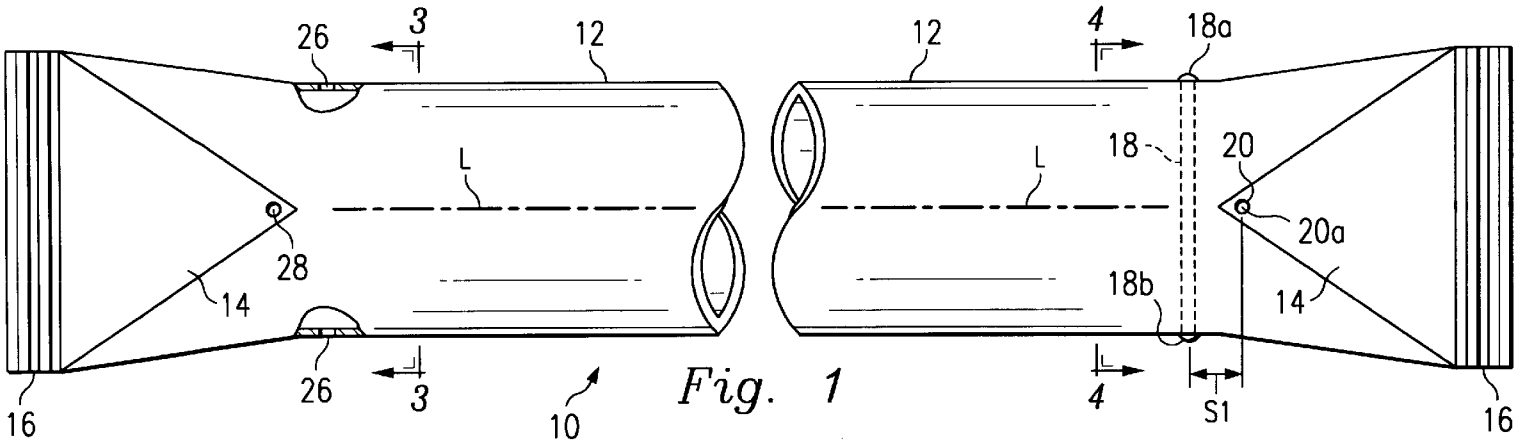
FIG. 1 is a side view illustrating an embodiment of the metal tube including tapered and crimped portions at opposite ends of the tube.

A structural member, FIG. 1, comprises a metal tube 10 formed of aluminum or steel. Tube 10 includes an elongated portion 12. Each end of tube 10 includes a flattened, tapered portion 14, and a keyed, crimped end portion 16. A first reinforcing member 18 and a second reinforcing member 20 are attached to the elongated portion 12 at the opposite ends adjacent the flattened, tapered portion 14. The first and second reinforcing members 18 and 20, respectively, may be formed of aluminum or steel, and are provided to extend through tube 10 in a direction substantially transverse to a longitudinal axis L of the tube 10.

Figure 2:
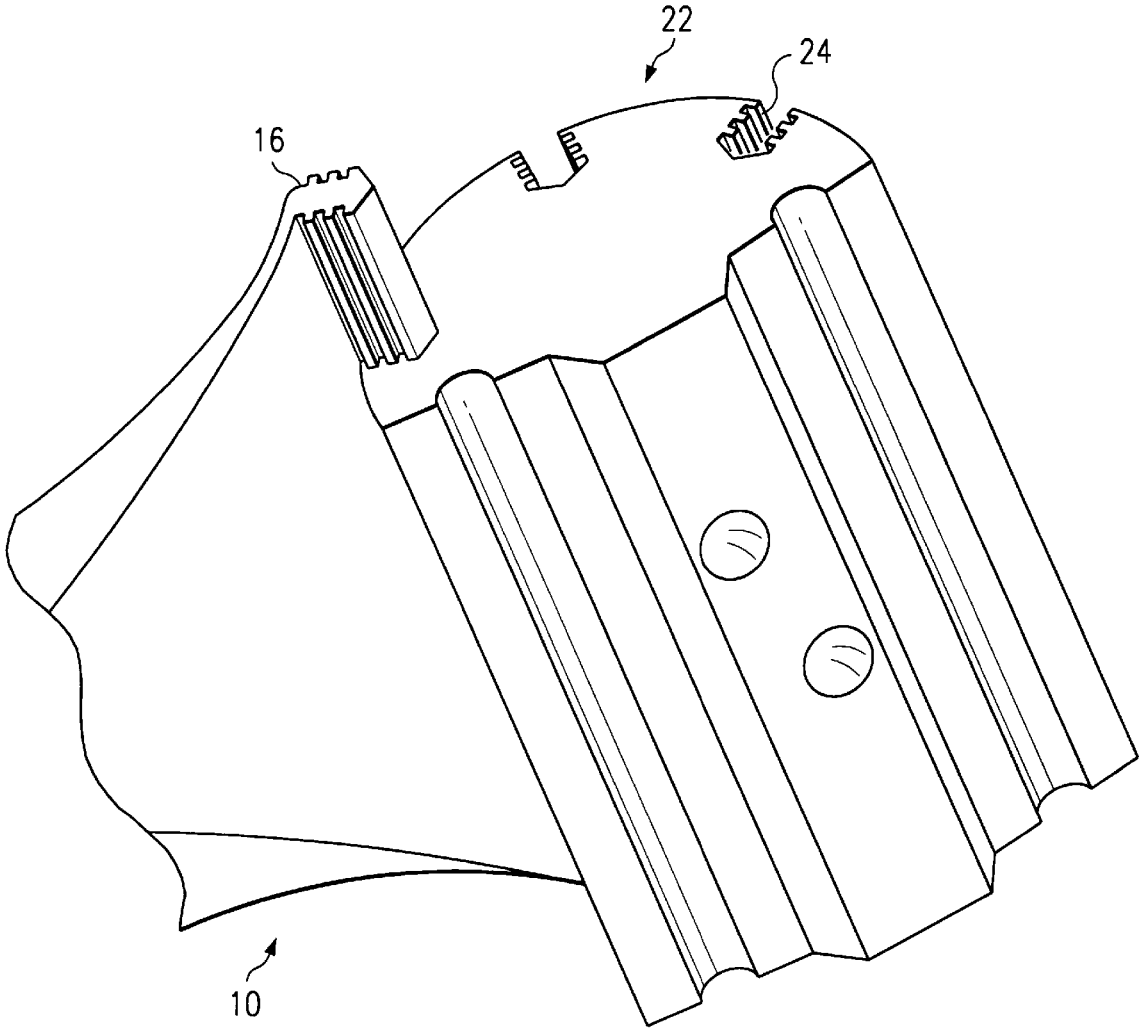
FIG. 2 is an isometric view illustrating an embodiment of a portion of a split hub having a tubular support member connected therewith.

Tubes 10, FIG. 2, are of the type generally used in connection with a hub 22, which may be of the split hub type, such that the keyed, crimped end portions 16 of tube 10 are engaged with keyed slots 24 in hub 22. The keyed, crimped ends 16 are sidably engaged with the keyed slots 24 in the well-known manner. When engaged with hub 22, tube 10 is exposed to tensile and compressive forces acting thereon. The compressive forces can cause tube 10 to deform in the area adjacent hub 22.

Figure 4:
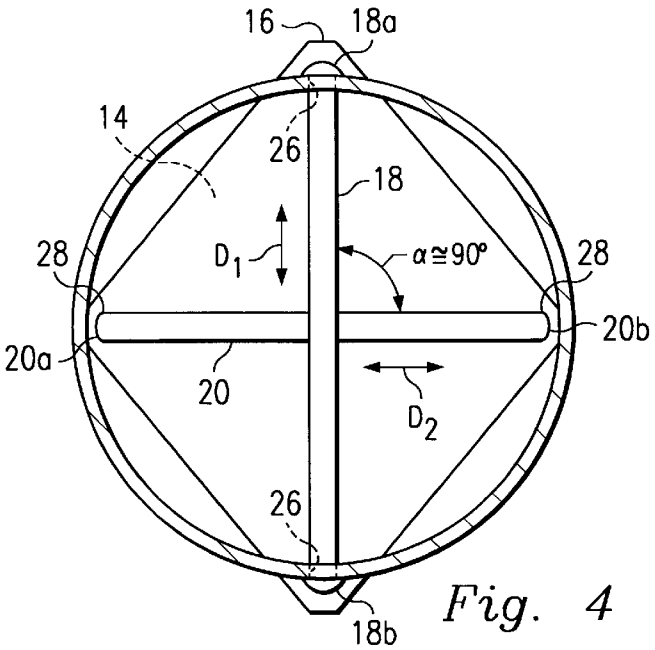
FIG. 4 is a cross-sectional view of the metal tube and reinforcing members taken along line 4—4 of FIG. 1.
Figure 3:
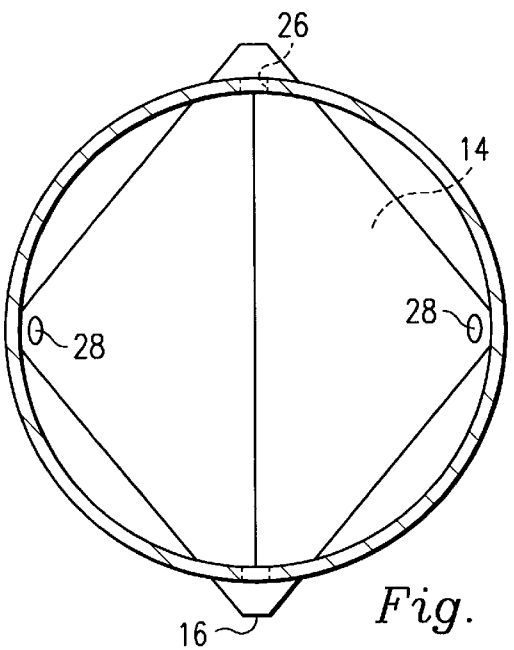
FIG. 3 is a cross-sectional view of the metal tube illustrating an embodiment of the metal tube, having opposed openings formed therein taken along line 3—3 of FIG. 1.

Tube 10, FIGS. 1 and 3, includes a first pair of opposed openings 26, formed therein, and a second pair of opposed openings 28, formed therein. First reinforcing member 18, FIG. 4, extends through the first pair of opposed openings 26, and second reinforcing member 20, extends through the second pair of opposed openings 28. To achieve enhanced structural reinforcement, the first reinforcing member 18 extends in a first direction D1, and the second reinforcing member 20, extends in a second direction D2, different from first direction D1. As illustrated in FIG. 4, directions D1 and D2 are substantially offset by angle of about 90 degrees. In addition, FIG. 1, first reinforcing member 18 is axially offset from second reinforcing member 20 so that the members 18 and 20 are spaced apart by a space S1 extending along axis L.

Tube 10, FIG. 3, is substantially of a circular cross-section along the elongated portion 12. The tube 10, FIGS. 1 and 3, are pre-formed or fabricated to include the flattened, tapered portion 14 and the keyed, crimped end portion 16. Opposed openings 26 and opposed openings 28 are formed in tube 10 by a suitable process, e.g. drilling or punching. The reinforcing members 18 and 20 are respectively inserted into the openings 26 and 28 so that the reinforcing members extend transversely across tube member 10. Ends 18*a* and 18*b* of first reinforcing member 18 are secured to tube 10 adjacent respective openings 26 by a suitable welding process such as tack welding. Similarly, ends 20*a* and 20*b* of second reinforcing member 20 are secured to tube 10 adjacent respective openings 28 by tack welding.

As it can be seen, the principal advantages of these embodiments are that the reinforcing members are individually installed and positioned to provide adequate reinforcement of the ends of the tube by using a minimal amount of material. Installation is quick and efficient and cost is minimal. In addition, the outer peripheral surface of the tube member is unobstructed by the reinforcing members. It has been found that a substantially improved resistance to end crippling is provided by only one reinforcing member extending transversely across the tube member. This is further enhanced by the use of two reinforcing members which are relatively axially offset and angularly offset at or about 90 degrees as set for the above.

As a result, one embodiment provides a structural member comprising a tube member having an elongated portion, a flattened, tapered portion, and a crimped end portion. At least one reinforcing member is attached to the tube adjacent the flattened, tapered portion. The reinforcing member extends transversely through the tube member.

Another embodiment provides a structural member comprising a tube member having a first and a second opposite end, an elongated portion between the opposite ends, a flattened, tapered portion adjacent each end, and a crimped portion at each end. A pair of reinforcing members are adjacent each end and are attached to the elongated portion adjacent the flattened, tapered portion, and extend transversely through the tube member.

A further embodiment provides a method of reinforcing a structural member. A tubular member is shaped to include an elongated portion and a flattened, tapered portion adjacent an end of the tubular member. The end of the tube is crimped adjacent the flattened, tapered portion. A first and second pair of opposed openings are formed in the elongated portion of the tube member adjacent the flattened, tapered portion. A first reinforcing member is inserted through the first pair of opposed openings so that the first reinforcing member extends transversely through the tubular member. A second reinforcing member is inserted through the second pair of opposed openings so that the second reinforcing member extends transversely through the tubular member. The first and second reinforcing members are then secured to the tubular member.

Although illustrative embodiments have been shown and described, a wide range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A structural member comprising:

a tube member having an elongated portion, a flattened, tapered portion, and a crimped end portion; and a first and a second reinforcing member, each reinforcing member being attached to the elongated portion, adjacent the flattened, tapered portion, and extending transversely through the tube member wherein the first reinforcing member extends in a first direction and the second reinforcing member extends in a second direction, different from the first direction.

2. The structural member as defined in claim 1 wherein the tube member includes a first pair of opposed openings formed therein and a second pair of opposed openings formed therein.

3. The structural member as defined in claim 2 wherein the first reinforcing member extends through the first pair of opposed openings and the second reinforcing member extends through the second pair of opposed openings.

4. The structural member as defined in claim 1 wherein the first reinforcing member is spaced apart from the second reinforcing member.

5. The structural member as defined in claim 1 wherein opposite ends of the first and second reinforcing members are welded to the tube member.

6. A structural member comprising:

a tube member having first and second opposite ends, an elongated portion between the opposite ends, a flattened, tapered portion adjacent each end, and a crimped portion at each end; and a pair of reinforcing members adjacent each end, each pair being attached to the elongated portion, adjacent the flattened, tapered portion, and extending transversely through the tube member wherein each pair of reinforcing members includes a first reinforcing member extending in a first direction and a second reinforcing member extending in a second direction, different from the first direction.

7. The structural member as defined in claim 6 wherein the tube member includes a first pair and a second pair of opposed openings formed therein adjacent each end.

8. The structural member as defined in claim 7 wherein the tube member includes a pair of opposed openings formed therein for receiving each reinforcing member.

9. The structural member as defined in claim 6 wherein the first reinforcing member is spaced apart from the second reinforcing member.

10. The structural member as defined in claim 6 wherein opposite ends of each first and second reinforcing member are welded to the tube member.

11. The structural member as defined in claim 6 wherein the crimped end portion of the tube is engaged With a hub member.

12. The structural member as defined in claim 6 wherein each reinforcing member is formed of aluminum.

13. The structural member as defined in claim 6 wherein each reinforcing member is formed of steel.

14. The structural member as defined in claim 6 wherein the tube member includes a circular cross-section.

15. The structural member as defined in claim 11 wherein each pair of reinforcing members includes a first reinforcing member extending in a first direction and a second reinforcing member extending in a second direction, angularly disposed relative to the first direction.

16. The structural member as defined in claim 15 wherein the first reinforcing member is spaced apart from the second reinforcing member.

17. A method of reinforcing a structural member comprising the steps of:

shaping a tubular member having an elongated portion to form a flattened, tapered portion adjacent an end of the tubular member;

crimping the end of the tube adjacent the flattened, tapered portion;

forming a first and a second pair of opposed openings in the elongated portion of the tube member adjacent the flattened, tapered portion;

inserting a first reinforcing member through the first pair of opposed openings so that the first reinforcing member extends transversely through the tubular member;

inserting a second reinforcing member through the second pair of opposed openings so that the second reinforcing member extends transversely through the tubular member; and securing the first and second reinforcing members to the tubular member.

18. The method as defined in claim 17 wherein the step of forming includes the step of drilling diametrically opposed openings through the tube member.

19. The method as defined in claim 17 wherein the step of securing includes the step of welding opposite ends of each reinforcing member to, the tubular member adjacent the respective openings.

20. The method as defined in claim 17 wherein the steps of inserting include the steps of inserting the first reinforcing member in a first direction and inserting the second reinforcing member in a second direction, different from the first direction.

* * * * *